US005113164A

United States Patent [19]

De Wames et al.

[11] Patent Number: 5,113,164

[45] Date of Patent: May 12, 1992

[54] SUPERCONDUCTORS WITH SWITCHABLE MAGNETIC DOMAINS

[75] Inventors: Roger E. De Wames; Ira B. Goldberg; Peter E. D. Morgan; Joseph J. Ratto; David B. Marshall; William F. Hall, all of Thousand Oaks, Calif.

[73] Assignee: Rockwell International Corporation, El Segundo, Calif.

[21] Appl. No.: 303,708

[22] Filed: Jan. 27, 1989

[51] Int. Cl.[5] ..... H01F 1/00; H01F 5/00

[52] U.S. Cl. ..... 335/216; 335/299; 338/325; 505/1; 310/90.5; 333/995

[58] Field of Search ..... 335/216, 299; 338/325; 505/1; 310/90.5; 333/995

[56] References Cited

U.S. PATENT DOCUMENTS 4,722,134 2/1988 Wilson ..... 335/216 X
4,797,386 1/1989 Gyorgy et al. ..... 335/216 X
4,886,778 12/1989 Moon et al. ..... 335/216

FOREIGN PATENT DOCUMENTS 0292436 11/1988 European Pat. Off. ..... 335/216
0027409 1/1989 Japan ..... 335/216
0160065 6/1989 Japan ..... 335/216

*Primary Examiner*—Gerald P. Tolin
*Assistant Examiner*—Ramon M. Barrera
*Attorney, Agent, or Firm*—John J. Deinken

[57] ABSTRACT

A tunable electromagnetic filter includes a type II superconducting medium which exhibits a permanent ferromagnetic component after exposure to a magnetic field. A magnetic field passes through the medium in a first direction, while an input conductor wound around the medium in a second direction perpendicular to the first direction receives an input signal, and an output conductor is wound around the medium in a third direction perpendicular to the first and second directions. At resonance of the medium, an alternating field magnetic component perpendicular to both the incoming signal and the magnetic field is created to induce a current of the resonant frequency in the output conductor.

1 Claim, 8 Drawing Sheets

SUPERCONDUCTORS WITH SWITCHABLE MAGNETIC DOMAINS

BACKGROUND OF THE INVENTION

This invention is concerned with the magnetic properties of superconducting materials.

The field of superconductivity was revolutionized in April 1986 with the discovery by Bednorz and Muller that certain types of metallic oxides become superconducting at temperatures considerably higher than the highest critical temperature ($T_c$) previously known for any superconducting material. Superconductors exhibit zero resistance, diamagnetism (the Meissner effect), Josephson tunneling, and a forbidden energy gap. These effects are observed in both soft (type I) and hard (type II) superconducting materials. The above phenomena have been extensively studied to understand the origins and physical mechanisms of these attributes and to find uses for these materials to meet the needs of society.

DESCRIPTION OF THE INVENTION

Figure 1:
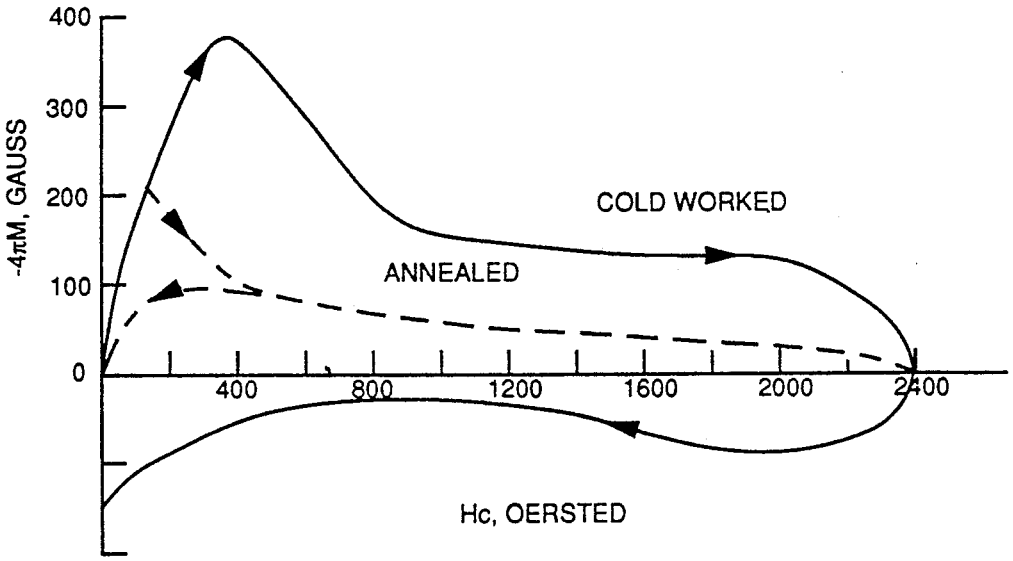
FIG. 1 is a plot of magnetization as a function of magnetic field for a low temperature superconductor.
Figure 2:
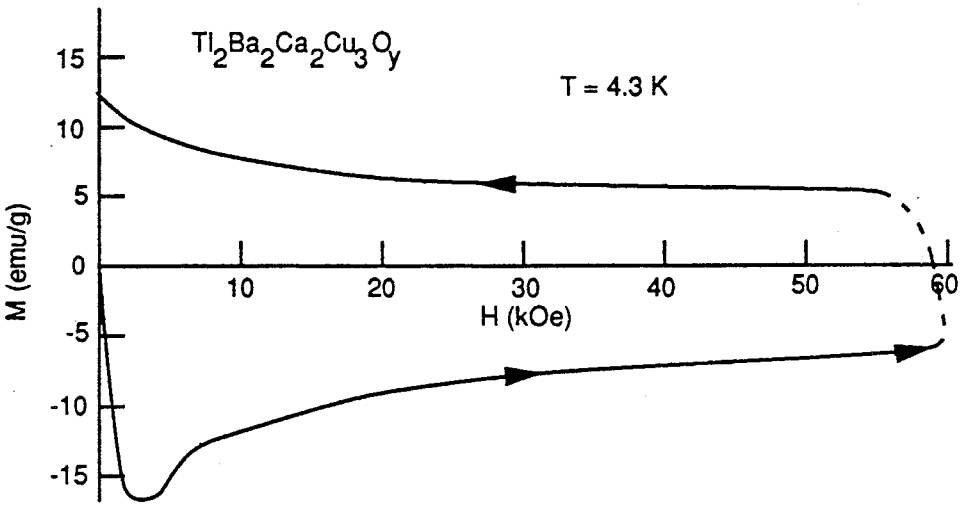
FIG. 2 is a plot illustrating the magnetization curve for a high temperature superconductor.

In type II superconductors large hysteresis in magnetization measurements is usually observed both in low temperature superconductors (LTS) and the recently discovered high temperature superconductors (HTS). FIG. 1 is a plot of magnetization as a function of magnetic field for a LTS (from Livingston, Physical Review, Volume 129, Page 1943 (1963)), while FIG. 2 illustrates the magnetization curve for an HTS (Iwasaki, et al., Japanese Journal of Applied Physics, Volume 27, Page L1631 (1988)). Similar data for a bismuth compound superconductor was reported by M. Baran, et al., Journal of Physics C. Solid State Physics, Volume 21, Page 6153 (1988).

Figure 3:
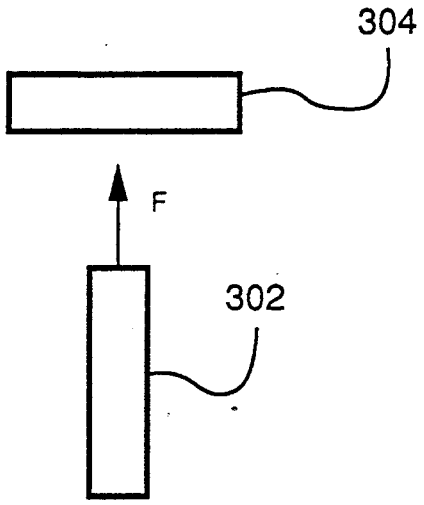
FIG. 3 illustrates the suspension of a small magnet from a thallium superconductor which was previously magnetized.
Figure 4:
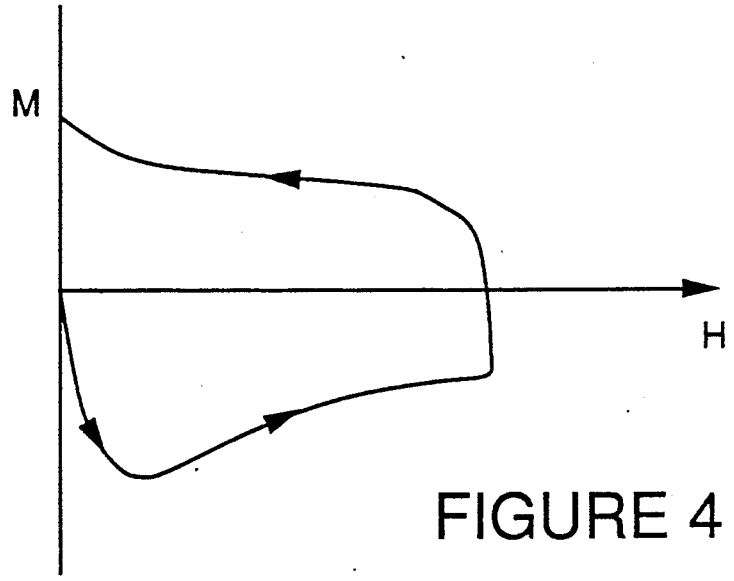
FIG. 4 is a plot of magnetization as a function of magnetic field.
Figure 5:
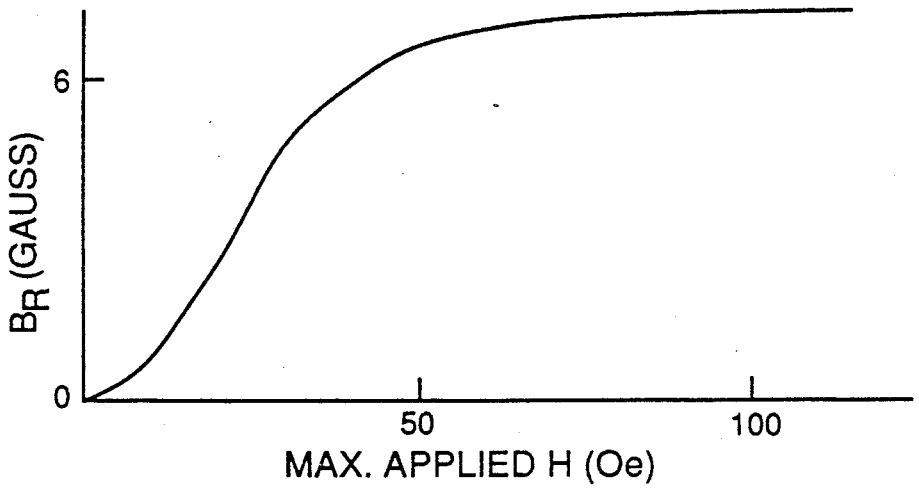
FIG. 5 is a plot of remanent field as a function of the applied field.

Note that the vertical axis in the LTS case is $-4\pi M$, whereas for HTS it is $4\pi M$. It is an outstanding feature of this invention to make use of the fact that in Type II superconductors the hysteresis loop is the diamagnetic equivalent of the hysteresis observed in weakly magnetized ferromagnets. (see Beam, Review of Modern Physics, Volume 36, Page 31 (1964). This can be seen by completing the curves in FIGS. 1 and 2 for negative values of the applied field. At a zero field value a remanent moment is induced and this moment is oriented in the direction of the applied field. Hence the sample exhibits both diamagnetism and ferromagnetism. This attribute explains the observations of suspension of either HTS or LTS superconductors from magnets (Harter, et al, Applied Physics Letters, Volume 53, Page 1120 (1988); Adler, et al., Applied Physics Letters, Volume 53, Page 2346 (1988)) or magnets from superconductors Marshall, et al., U.S. Pat. No. 4,879,537, the condition being that the spatial derivative of the magnetic force is positive. The net magnetic force has both a negative and positive component, the repulsive component having its origin in the diamagnetic properties, while the attractive component arises from the ferromagnetic component. In FIG. 3 is illustrated the suspension of a small magnet 302 from a thallium superconductor 304 which was previously magnetized with a larger magnet having a strength of 3 KGauss. In this situation both in levitation and suspension experiments the small magnet orients so that its moment is parallel to the remanent moment induced by the large magnet. The levitation condition is satisfied by the diamagnetic force. FIGS. 4–7 illustrate the data which supports the potential use of this attribute of type II superconductors which exhibits a permanent ferromagnetic component following the removal of the applied field. FIG. 4 is a plot of magnetization as a function of magnetic field depicting measurements made by Iwasaki, et al. FIG. 5 illustrates the remanent field plotted as a function of the applied field. Note that saturation is observed at relatively small field values. The magnitude of the saturated field will depend on the material system and the microstructure which provides the centers for flux trapping. Similar to the observation that high current densities are related to pinning forces, high remanent fields also depend on the mechanisms of pinning. Based on a physical model for the structure of these types of materials proposed by Mendelssohn (Proceedings of the Royal Society (London) Volume A152, Page 34 (1935)), Bean developed expressions for the magnetization of such specimens. (Bean, Physical Review Letters, Volume 8, Page 250 (1962), Volume 9, Page 93 (1962)). In this model the calculation of the critical current density $J_c$ of the filaments is the limiting parameter. This parameter is a sensitive function of the material properties and the ability to support high remanent fields is directly related to the properties required to support high critical currents. The Bean calculation captures the basic physics but the situation is likely to be more complex. Since the above measurements were performed at liquid nitrogen temperatures, it is expected that the saturation value of the remanent field will increase with decreasing temperature since the trapping mechanism is believed to be a thermally activated process.

This signature can of course be modified or erased by increasing the temperature, passing a high current, or alternating the field. Hence it is possible to utilize the phenomenon to achieve rotor motion of a small magnet suspended or levitated from a superconductor.

Figure 6:
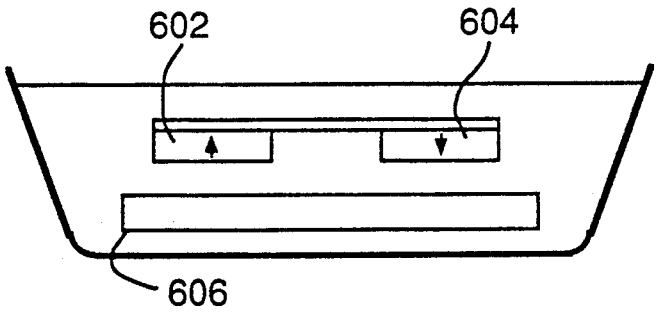
FIG. 6 depicts the placement of magnets on a superconductor to induce remanent fields in the superconductor.
Figure 7A:
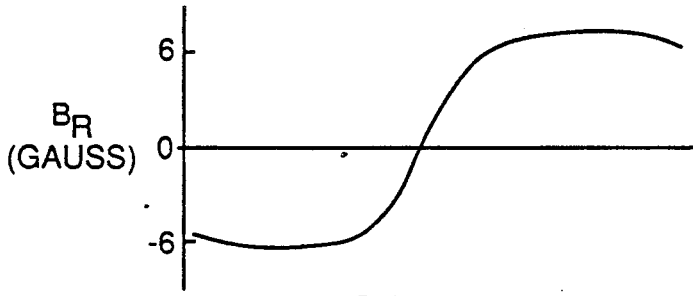
FIG. 7 illustrates the reversal of the magnetic domains which occurred when remanent fields were induced as in FIG. 6.
Figure 7B:
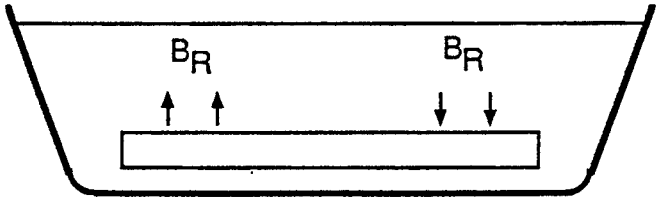

FIGS. 6 and 7 illustrate the use of this invention to spatially magnetize a superconductor. In FIG. 6, the magnets 602 and 604 were placed on the superconductor 606 to induce the remanent fields and then removed. In FIG. 7, the data illustrate the reversal of the magnetized domains which occurred. A significant question is the limit of the spatial frequency of this change in magnetization which can be supported by the superconductors. In principle from fundamental considerations the upper limit will be controlled by the coherence length which is of the order of tens of Angstroms in these materials. In real situations this spatial frequency is likely to be limited by the nature and type of pinning force which inhibits the motion of flux.

Figure 8:
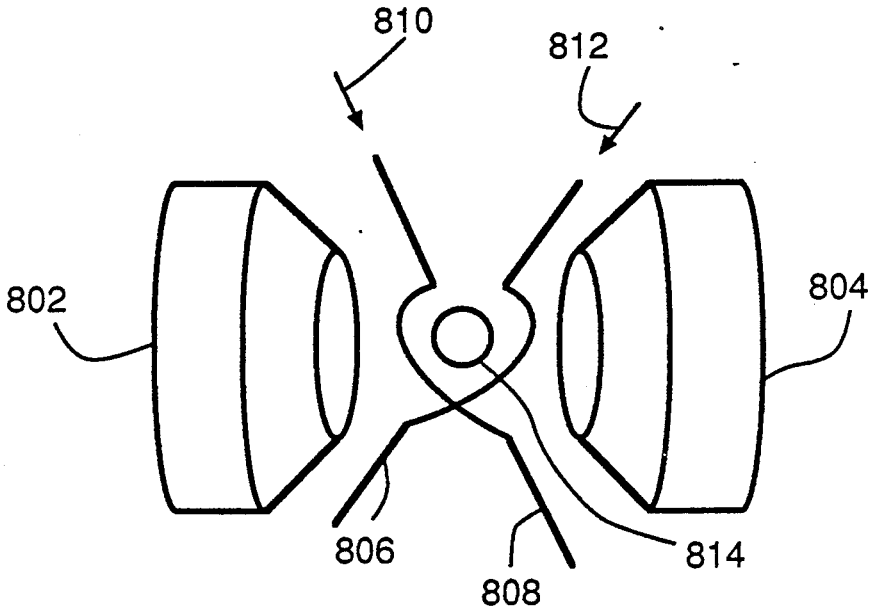
FIG. 8 illustrates a tunable electromagnetic filter which uses a type II superconductor.

This invention is also applicable to tunable electromagnetic filters. Typical electronic filters exhibit a limited bandpass. In order to obtain a narrow bandpass, microwave filters use a "Bloch" configuration. Such a device as shown in FIG. 8 consists of a magnetic field (in the z-direction) from the magnet poles 802 and 804, an input conductor line 806 wound around a direction perpendicular to the magnetic field (in the x-direction), and an output conductor line 808 wound around a direction perpendicular to the other loop and the magnetic field (in the y-direction). A ferrite is placed in a magnetic field. This arrangement allows resonance at a magnetic field determined by the magnetic anisotropy and the geometry of the material. At resonance, an alternating field magnetic component perpendicular to both the incoming signal 810 and the magnetic field is created (i.e., along the y-direction). This, in turn, induces a current 812 of the resonant frequency in the output line. No other input frequencies are induced in the output line.

FIG. 8 illustrates a tunable electromagnetic filter which uses a type II superconductor. When the thallium superconductor 814 is exposed to a magnetic field, a current loop is induced in the material. The magnitude of the current is temperature dependent. Such a current loop establishes a cyclotron resonance, analogous to a ferromagnetic resonance, where the resonance frequency is given by:

$$f = keB/2\pi m_e$$

where k is a constant between 1 and 2, depending on whether hole-electron pairs or only electrons are responsible for the current loop, e is the electron charge, B is the applied field, and $m_e$ is the electron mass. The lower limit of frequency would be the minimum remanent magnetization which will be a function of the temperature of the superconductor. Such a configuration will create very narrow bandpass filters from about 100 MHz (depending on temperature) to greater than 20 GHz. The frequency could be accurately tuned by the magnetic field.

The preferred embodiments of this invention have been illustrated and described above. Modifications and additional embodiments, however, will undoubtedly be apparent to those skilled in the art. Furthermore, equivalent elements may be substituted for those illustrated and described herein, parts or connections might be reversed or otherwise interchanged, and certain features of the invention may be utilized independently of other features. Consequently, the exemplary embodiments should be considered illustrative, rather than inclusive, while the appended claims are more indicative of the full scope of the invention.

The teaching of the following documents, which are referred to herein, is incorporated by reference:

Adler, et al., Applied Physics Letters, Volume 53, Page 2346 (1988);

Baran, et al., Journal of Physics C. Solid State Physics, Volume 21, Page 6153 (1988);

Beam, Review of Modern Physics, Volume 36, Page 31 (1964);

Bean, Physical Review Letters, Volume 8, Page 250 (1962), Volume 9, Page 93 (1962);

Harter, et al, Applied Physics Letters, Volume 53, Page 1120 (1988);

Iwasaki, et al., Japanese Journal of Applied Physics, Volume 27, Page L1631 (1988);

Livingston, Physical Review, Volume 129, Page 1943 (1963);

Marshall, et al., U.S. patent application Ser. No. 223,591, filed Jul. 25, 1988;

Mendelssohn (Proceedings of the Royal Society (London) Volume A152, P 34 (1935).

We claim:

1. A tunable electromagnetic filter, comprising:

a type II superconducting medium which exhibits a permanent ferromagnetic component after exposure to a magnetic field;

a means for providing a magnetic field passing through the medium in a first direction;

an input conductor for receiving an input signal wound around the medium in a second direction perpendicular to the first direction;

an output conductor wound around the medium in a third direction perpendicular to the first and second directions, such that at resonance of the medium, an alternating field magnetic component perpendicular to both the incoming signal and the magnetic field is created to induce a current of the resonant frequency in the output conductor.

* * * * *